US012490808B2

(12) United States Patent
Stief et al.

(10) Patent No.: US 12,490,808 B2
(45) Date of Patent: Dec. 9, 2025

(54) DEVICE FOR SUPPORTING THE PHYSIOLOGICAL FOOT CHARACTERISTICS DURING MOVEMENT AND IN STATIC CONDITIONS

(71) Applicant: (ts)2 GmbH, Osnabrueck (DE)

(72) Inventors: Thomas Stief, Giessen (DE); Tino Sprekelmeyer, Bissendorf (DE)

(73) Assignee: (ts)2 GmbH, Osnabrueck (DE)

( * ) Notice: Subject to any disclaimer, the term of this patent is extended or adjusted under 35 U.S.C. 154(b) by 521 days.

(21) Appl. No.: 17/264,319

(22) PCT Filed: Jul. 26, 2019

(86) PCT No.: PCT/EP2019/070146
§ 371 (c)(1),
(2) Date: Jan. 29, 2021

(87) PCT Pub. No.: WO2020/025467
PCT Pub. Date: Feb. 6, 2020

(65) Prior Publication Data

US 2021/0289885 A1 Sep. 23, 2021

(30) Foreign Application Priority Data

Aug. 1, 2018 (DE) ..... 10 2018 118 609.6

(51) Int. Cl.
*A43B 17/00* (2006.01)
*A43B 7/142* (2022.01)
(Continued)

(52) U.S. Cl.
CPC ..... *A43B 17/006* (2013.01); *A43B 7/142* (2013.01); *A43B 7/1445* (2013.01); *A43B 17/02* (2013.01)

(58) Field of Classification Search
CPC ..... A43B 7/1467; A43B 7/1464; A43B 17/04; A43B 17/06
See application file for complete search history.

(56) References Cited

U.S. PATENT DOCUMENTS 2,691,227 A 10/1954 Sachs
5,138,776 A 8/1992 Levin
(Continued)

FOREIGN PATENT DOCUMENTS

CN 104856345 A 8/2015
EP 0283010 A2 9/1988
(Continued)

OTHER PUBLICATIONS

Office action from parallel CN Patent Application 201980065333.3 dated Oct. 26, 2021, 8 pages (for reference purposes only).
(Continued)

*Primary Examiner* — Megan E Lynch
(74) *Attorney, Agent, or Firm* — VIERING JENTSCHURA & PARTNER MBB

(57) ABSTRACT

A device for supporting the human foot may include a first layer forming an arch in a central region of the device and a second layer that is connected to the first layer in a first end region and in a second end region of the device. The device may include at least one deflection element with dorsiflexion of the device. The second layer may be designed to transmit tension acting in the second end region via the deflection element to the first layer in the second end region in such a way that the dorsiflexion leads to an increase in the height of the arch formed by the first layer. The deflection element may be arranged at least partially between the first layer and the second layer, such that the first layer and second layer are spaced apart at a distance specified by the deflection element(s).

18 Claims, 6 Drawing Sheets

(51) Int. Cl.
*A43B 7/1445* (2022.01)
*A43B 17/02* (2006.01)

(56) References Cited

U.S. PATENT DOCUMENTS

| | | | | |
|---|---|---|---|---|
| 5,706,589 | A | 1/1998 | Marc | |
| 6,023,861 | A * | 2/2000 | Bizzotto | A43B 13/12 36/179 |
| 6,345,455 | B1 * | 2/2002 | Greer, Jr | A61F 5/14 36/161 |
| 8,984,770 | B1 | 3/2015 | Piontkowski | |
| 2009/0188129 | A1 * | 7/2009 | Fusco | A43B 7/144 36/44 |
| 2011/0302805 | A1 * | 12/2011 | Vito | A43B 7/1464 36/145 |
| 2013/0031804 | A1 * | 2/2013 | Abshire | A43B 7/144 36/103 |
| 2013/0219744 | A1 * | 8/2013 | Case | A43B 17/023 36/43 |
| 2014/0000125 | A1 * | 1/2014 | Butler | A43B 13/386 36/43 |
| 2015/0237956 | A1 | 8/2015 | Yoo | |
| 2017/0000211 | A1 | 1/2017 | Vindriis | |
| 2017/0258182 | A1 * | 9/2017 | Takahashi | A43B 7/125 |
| 2017/0280820 | A1 * | 10/2017 | Green | A43B 17/14 |
| 2019/0313731 | A1 * | 10/2019 | Dwyer | A43B 7/1445 |
| 2020/0163412 | A1 * | 5/2020 | Mayer | A43B 13/14 |

FOREIGN PATENT DOCUMENTS

| | | | |
|---|---|---|---|
| EP | 2822414 | B1 | 10/2015 |
| JP | S4898343 | U | 11/1973 |
| JP | S5745305 | U | 3/1982 |
| JP | 3184409 | U | 6/2013 |
| RU | 2120261 | C1 | 10/1998 |
| RU | 13945 | U1 | 6/2000 |
| RU | 2160572 | C2 | 12/2000 |
| RU | 148057 | U1 | 11/2014 |

OTHER PUBLICATIONS

Search report from parallel RU Patent Application 2021103469 dated Sep. 3, 2021, 2 pages (for reference purposes only).
Office Action dated May 24, 2022 from parallel JP Patent Application 2021-529516, 12 pages (for reference purposes only).
Examination report from parallel German Patent Application 10 2018 118 609.6 dated Mar. 15, 2019, 6 pages (for reference purposes only).
International search report from parallel PCT Patent Application PCT/EP2019/070146 dated Oct. 1, 2019, 9 pages (for reference purposes only).

* cited by examiner

DEVICE FOR SUPPORTING THE PHYSIOLOGICAL FOOT CHARACTERISTICS DURING MOVEMENT AND IN STATIC CONDITIONS

CROSS-REFERENCE TO RELATED APPLICATIONS

The present application is a national stage entry according to 35 U.S.C. § 371 of PCT application No.: PCT/EP2019/070146 filed on Jul. 26, 2019; which claims priority to German Patent Application Serial No.: 10 2018 118 609.6 filed on Aug. 1, 2018; all of which are incorporated herein by reference in their entirety and for all purposes.

TECHNICAL FIELD

The disclosure relates to a device for supporting the physiological foot characteristics in the form of an insole or a device arranged permanently in or on a shoe.

BACKGROUND

Human feet, being composed of bones, muscles, tendons and ligament structures, are flexible units which permit a stable upright posture of the whole body, via an optimal adaptability of the feet to a wide variety of ground conditions, and which also serve as shock absorbers in order to relieve the stress placed on the whole body during locomotion. Moreover, the feet serve as levers for propulsion when walking. To ensure this function, the metatarsal region and the calcaneal region of the foot have to adopt a stable configuration.

If this interplay between the flexibility and stability of the feet is disturbed, it can cause symptoms that affect not just the feet but also the whole body. In order to treat such symptoms, devices such as orthopedic inserts or other insoles, for example, are used, which can be arranged (removably) in shoes and which have properties of relieving, supporting, guiding or stimulating the feet. Such devices can also be provided to support the functions of the feet during sports activities.

An example of a device for supporting the feet, which can be fixed as a sole on the outside of shoes, is disclosed in EP 2 822 414 Bl. The latter discloses a sports shoe which is intended to support a foot in different phases during running. The shoe comprises a sole in which an elastic band is guided. The elastic band serves to suitably shape the sole when the sole is not loaded.

Particularly when walking, running and jumping, the feet make use of what is called the windlass mechanism. Here, the metatarsal region and parts of the calcaneal region are elevated and stretched three-dimensionally as a result of (upward) hyperextension of the toes, inter alia when standing on the forefoot, and resulting tensioning of the tendons of the toe flexor muscles lying on the plantar fascia, and a stable lever configuration is generated by the locking of the metatarsal and calcaneal bones. The windlass mechanism is supported by osseous structures embedded in the tendons, the so-called sesamoid bones. The sesamoid bones ensure an additional spacing of tendon and bone and thus strengthen the described elevation of the metatarsal and calcaneal regions.

Analogously to when a bowstring of a bow is stretched, deformation energy is stored when the tendons of the plantar fascia stretch (bow and bowstring model). This energy is made available for further locomotion. In particular, this energy is converted into acceleration work which, for example during walking, running and/or jumping, is utilized for efficient and rapid elevation of the foot and of the whole body.

However, in order to ensure the functions of the described mechanisms, the muscles and tendons in particular of the foot need to have sufficient physiological stiffness and elasticity and physiological length ratios. In many medical conditions of the feet, however, these characteristics are no longer present, and therefore the described interplay between flexibility and stability of the feet is no longer present.

In view of the above, it is an object of the present disclosure to make available a device for supporting the functions of the human foot, which device can be arranged permanently or removably in a shoe and can actively support the interplay between flexibility and stability of the feet and energy-efficient locomotion. The aim is to ensure that the dynamic functions of the feet are actively supported as naturally as possible. It is in particular a further object of the present disclosure to make available a device which supports the human foot and which is able to support or even replace the described lever function of the calcaneal and metatarsal regions, by locking the joints, the arch-shaped stretching of the metatarsal region and of parts of the calcaneal region, and the energy-efficient elevation of the feet.

SUMMARY

A device for supporting the human foot and its functions, in particular during the gait cycle, may be arranged permanently or removably in a shoe. In a non-limiting embodiment, the device is an insole, for example for a sports shoe and/or an everyday shoe. Particularly in this case, the device can be arranged removably in the shoe. In another embodiment, the device can be designed as a constituent part of a shoe. Along a longitudinal axis, which corresponds to a longitudinal axis of a shoe, the device can be divided, in accordance with a human foot, into a heel region (a first end region), a metatarsal region (a central region), and a forefoot region (a second end region). These regions correspond to respective regions of a foot when the device is arranged in a shoe or is designed as part of a shoe.

In particular, a device for supporting the human foot, wherein the device comprises at least one first layer, may form an arch at least in a central region of the device, and at least one second layer, which is connected to the first layer in a first connection region of a first end region in a heel region of the device and in a second connection region of a second end region in a forefoot region of the device, wherein the device comprises at least one deflection element, which is arranged between the first connection region and the second connection region and at least partially between the first layer and the second layer, such that the first layer and the second layer have, at the location of the deflection element, a spacing from each other that is predefined by the at least one deflection element, wherein the second layer is tensioned between the first connection region and the second connection region via the at least one deflection element, and wherein the second layer is designed such that tension acting in the second end region during flexion of the device is transmitted, via the at least one deflection element, to the first layer in the first end region in such a way that the flexion leads to an increase in a height of the arch formed by the first layer.

The device further comprises at least one first layer which, at least in the metatarsal region (in the central region), forms a convex arch or is stretched three-dimensionally. The first layer can be, for example, a two-dimensional structure which is adapted in outline to an inner shape of a shoe. The first layer thus has a contour shape which corresponds to a shoe insert or shoe insole. If appropriate, a plurality of first layers can be provided. For example, a plurality of first layers can be arranged next to each other along the longitudinal axis. Additionally or alternatively, a plurality of first layers arranged above each other, for example in an assemblage, can be provided. A first layer can, as a three-dimensional body, have an inner structure, for example cavities, partial layers and/or suitable filler materials.

The arch formed by the first layer extends from the heel region (the first end region) of the device into the metatarsal region (the central region) of the device. In other words, the first layer forms an at least partially three-dimensionally convex surface in which an arch height is suitably adapted to a corresponding profile of a sole of the human foot. However, in subregions, the first layer can also have another suitable shape adapted to the human foot. For example, the first layer can be shaped concavely in the heel region (in the first end region) and in the outer metatarsal region (an outer part of the central region). The device can thus be adapted in its regions to corresponding regions of the human foot, which helps support the functions of the human foot in a manner as true as possible to nature.

In a non-limiting embodiment, the first layer is filled at least partially or in some sections with a structured filler material. The filler material can for example have trabeculae, i.e. rod-like structures, as may also appear in human organs. Such a structured filling of the first layer can support or even replace the function of the device in supporting the natural function of the foot, such as the windlass effect. For this purpose, the filling can be provided in suitable regions that can be adapted individually to a foot. In embodiments, a homogeneity of the filling of the first layer through the entire volume of the first layer can be adapted to a desired use. To further support the flexibility of the first layer, a material reduction can be provided at suitable locations in order to increase the flexibility specifically in such regions.

In a non-limiting embodiment, the first layer can have a plurality of depressions or openings which have an elongate oval design. In the case of the openings, the first layer can be penetrated completely, whereas the depressions can reach only partially through the first layer in the manner of a blind bore. In embodiments, both depressions and openings can be provided. This plurality of depressions or openings in the first layer can permit control of the bending flexibility and torsional flexibility in different regions of the first layer. At the same time, the plurality of depressions or openings can permit increased cutaneous secretion and air circulation.

To be able to make available a bow function of the above-described bow and bowstring model, the first layer is made of a material which has suitable dimensional stability and/or which acquires dimensional stability through suitably shaped (support) elements (second deflection elements) in order to ensure the arch shape of the first layer. On the other hand, the material is flexible enough to permit compression of the first layer and an associated increase in the arch height during upward flexion (dorsiflexion) of the forefoot region. In embodiments, materials that have proven suitable for the dimensionally stable variant are polyethylene (PE), polyvinyl chloride (PVC), polyamides (PA), polyamide 11 (PA11), polyamide 12 (PA12), polylactides (PLA), acrylonitrile-butadiene-styrene copolymer (ABS) and/or a fiber composites such as Kevlar, carbon or glass fiber composites, and various metallic substances and other additively processible materials. The first layer can be produced, in particular from these materials, such that an optimum ratio of layer weight to layer strength can be achieved.

The device moreover comprises a second layer which is connected, such as in a tension-resistant manner, to the first layer in the heel region (in the first end region) and in the forefoot region (in the second end region). For this purpose, for example, the second layer and the first layer can be connected releasably, partially releasably or non-releasably in different embodiments by means of suitable techniques. In different embodiments, the first layer and the second layer can be connected cohesively (for example adhesively bonded, crosslinked, welded, additively processed, vulcanized or soldered). In different embodiments, the first layer and the second layer can also be connected by form-fit engagement, for example via a tongue-and-groove connection, a toothed connection or a dovetail connection. In different embodiments, the first layer and the second layer can be connected by force-fit engagement, for example via a hook-and-loop fastener. The first layer and the second layer can be connected by form-fit and force-fit engagement, for example riveted or screwed. In different embodiments, the first layer and the second layer can also be formed integrally with each other.

The second layer is a two-dimensional structure which has a smaller surface area than the first layer. As in the case of the first layer, in the case of the second layer too it is also possible to provide a plurality of second layers. For example, a plurality of second layers can be arranged next to each other along the longitudinal axis (a plurality of bowstrings in the bow and bowstring model). Additionally or alternatively, a plurality of second layers arranged above each other can also be provided, for example in an assemblage. A second layer can also, as a three-dimensional body, have an inner structure, for example cavities, partial layers and/or suitable filler materials. The second layer is arranged on a side of the first layer directed away from the arch. In other words, the first layer is an upper layer, and the second layer is a lower layer, when the device is arranged in a shoe or is designed as part of a shoe.

In order to be suitably adapted to the shape of a sole of a human foot, the first layer can, in a embodiment, form a corresponding shape of a three-dimensional arch. For this purpose, in a embodiment, the height of the arch can drop off laterally in both directions from a region of greatest height. In other words, the first layer can form an at least partially three-dimensionally convex surface in which an arch height is suitably adapted to a corresponding profile of the sole of the human foot. As has been mentioned, the first layer can form a three-dimensionally convex, upwardly bulging arch, for example in a lateral metatarsal region (a lateral central region), whereas in other regions it can have other suitable shapes adapted to the human foot. For example, the first layer can be concavely shaped in a heel region (the first end region) and in an outer metatarsal region (an outer central region) and thus afford advantageous effects for the device.

According to a non-limiting embodiment, the device comprises at least one deflection element. Moreover, according to a non-limiting embodiment, the second layer is designed such that tension (or a corresponding force acting along the second layer) acting in the forefoot region (in the second end region), during flexion of the device, is transmitted via the at least one deflection element to the first layer in the heel region (in the first end region) such that the flexion leads to an increase in a height of the arch formed by the first layer. The flexion here is a dorsiflexion. As a person skilled in the art will understand, a dorsiflexion of the device corresponds to a flexion directed upward toward the instep, when the device is used in a shoe.

The device is designed such that, after the dorsiflexion, a return movement of the arch formed by the first layer to a starting configuration causes a plantar flexion (i.e. flexion toward the sole) of the forefoot region (the second end region). In other words, the increase in the height of the arch formed by the first layer, brought about by the dorsiflexion of the device in the forefoot region, is reversible.

In embodiments, the device is thus suitable for actively supporting the foot at least during the gait cycle. In other words, the dorsiflexion of the device in the forefoot region has the effect that the arch formed by the first layer actively presses the foot upward. In contrast for example to conventional inserts, for example in the sports sector, which merely simulate the shape of the sole of the human foot and thus passively support the foot, the device is able to actively support the foot in its movement, for example during the gait cycle. The device can likewise support the foot in other activities, for example for jumping or running, such that the device can be advantageously used for example in the form of an insole in any type of shoe, particularly also in everyday shoes or sports shoes. The active movement of the arch formed by the first layer (arch elevation upon dorsiflexion, and return to the starting configuration upon subsequent flexion in the opposite direction) promotes a particularly natural function of the device supporting the human foot.

In order for this purpose to make available the function of a bowstring in the above-described bow and bowstring model, the second layer is made of a material having in particular a strength that corresponds to or exceeds the strength of the first layer. Compared to the first layer, the second layer stretches to a lesser extent under loading. The second layer should have the best possible strength to weight ratio, which can be achieved not just by the choice of a suitable material but also by shaping.

In embodiments, suitable materials have proven to be tension-resistant plastics such as polyamide 11 (PA11), polyamide 12 (PA12), polyether ether ketone (PEEK), polyvinylidene fluoride (PVDF) and/or fiber composites such as Kevlar, carbon or glass fiber composites.

Moreover, the second layer is two-dimensional, wherein a width (perpendicular to the thickness and perpendicular to the length) of the second layer is, at least in some sections, set in relation to the width of the first layer in such a way that the second layer is, one the one hand, wide enough to be able to take up stresses that occur, without the material of the second layer being overloaded, and, on the other hand, narrow enough to achieve a weight reduction. In other words, by shaping and by choice of material, it is possible to ensure that the second layer is sufficiently strong to be able to suitably transmit stresses and forces that occur.

According to a non-limiting embodiment, the at least one deflection element is arranged at least partially between the first layer and the second layer. In other words, at least part of the deflection element is arranged between the first layer and the second layer, such that at least this part results in a spacing between the first layer and the second layer. In a non-limiting embodiment, the at least one deflection element is an element separate from the layers. In non-limiting embodiments, the at least one deflection element can thus be a three-dimensional solitary body, which is placed loosely on the first and/or second layer.

In other embodiments, the at least one deflection element can be rigidly connected to the first layer and/or to the second layer. For this purpose, the at least one deflection element can be connected to the first layer and/or the second layer releasably, partially releasably or non-releasably, such as connected cohesively (for example adhesively bonded, crosslinked, welded, additively processed, vulcanized, soldered), by form-fit engagement (for example via a tongue-and-groove connection, a toothed connection, a dovetail connection), by force-fit engagement (for example via a hook-and-loop fastener) or by form-fit and force-fit engagement (for example riveted, screwed). In other embodiments, the deflection element can be formed integrally with the first and/or second layer.

The shape of the deflection element is adapted to a curvature of a sole of a human foot and is chosen such that it can support a lever effect of the deflection element. In other words, the shape is chosen such that the at least one deflection element can suitably transmit the above-described stresses that occur upon dorsiflexion of the forefoot region (the second end region), in order thereby to support the bow and bowstring function of the device. In a non-limiting embodiment, the first layer and/or the second layer can have a thickening in the region of the deflection element, in order thereby to form a mechanical counterbearing and to contribute to the stabilization of the device.

According to a non-limiting embodiment, the deflection element is arranged at least partially between the first layer and the second layer such that the first layer and the second layer are at a spacing from each other that is predefined by the at least one deflection element. In other words, the at least one deflection element is provided to set a desired spacing between the first layer and the second layer. Here, this spacing can be a minimum spacing between the layers at the location of the at least one deflection element, which spacing becomes greater in particular in the central region in which the first layer forms the arch.

The at least one deflection element, which is arranged in a transition region between metatarsal region (the central region) and forefoot region (the second end region), can thus be designated as a sesamoid element. The action of the at least one deflection element is analogous to the action of a sesamoid bone, i.e. a small bone which is embedded in a tendon and which causes an additional spacing of the tendon from the bone. As a result of the increased spacing, a greater lever for the tendon is provided at the sesamoid bone, such that less force is needed to move the bone connected to the tendon. Analogously to this, a lever effect can be provided via the at least one deflection element according to a non-limiting embodiment, such that the second layer can optimally transmit stresses that occur upon dorsiflexion of the device in the forefoot region.

The spacing between the layers, which is predefined by the deflection element, makes it possible to increase an enlargement of the arch, formed by the first layer, upon dorsiflexion of the device in the second end region. To put it another way, the setting of the spacing, through a suitable choice of the size of the deflection element, can be used to adjust the arch enlargement upon dorsiflexion of the device. By suitable adaptation of the at least one deflection element, the device can thus be adapted individually to a foot and to desired applications. The at least one deflection element can be suitably dimensioned. However, in different embodiments, it is also possible to provide a plurality of deflection elements which, in terms of distribution and size, are suitably adapted to a shape of the sole of a human foot. Thus, in a non-limiting embodiment, at least two deflection elements, such as of different size, for example of different volumes, can be provided in a transition region between the metatarsal region (the central region) and the forefoot region (the second end region), at least partially between the first layer and the second layer, such as substantially along a lateral width of the device.

The arch enlargement can be set not only via the dimensioning of the at least one deflection element but also via a positioning of the deflection element between the layers. In different embodiments, a positioning of the at least one deflection element can be used to optimize support of the windlass effect. In a non-limiting embodiment, the at least one deflection element is arranged, in a transition region between the metatarsal region (central region) and the forefoot region (second end region), at least partially between the first layer and the second layer. Calculated from a start of the heel region (first end region) in the direction of the forefoot region (second end region) along the longitudinal axis, the at least one deflection element can be arranged at a distance from this start corresponding to about 45% to 85% (such as 50% to 82%, or 60% to 80%) of the total length of the device. It has been found that, by arranging the at least one deflection element in this region of the device, the windlass effect can be optimally supported, since the position of the at least one deflection element in this region very effectively simulates a position of the natural deflection elements, the sesamoid bones. In this region, it may also be possible or necessary to adapt the position for certain pathologies and/or customers/patients.

A spacing, set by the at least one deflection element, between the first layer and second layer at the location of the deflection element can be in the range of 0.1 to 20 mm, such as ranging from 0.2 to 10 mm, or ranging from 0.5 to 8 mm, or ranging from 1 to 5 mm.

In other words, the deflection element is provided such that, in the event of a bending of the device in the forefoot region (in the second end region) toward the instep, a stress or force applied to the second layer, as in the above-described bow and bowstring model, increases the height of an arch formed by the first layer, i.e. for example causes a three-dimensional arch in the region of the metatarsal region to bulge farther upward.

The at least one deflection element is arranged along a width direction of the device. The deflection element can have an elliptic shape along a transverse axis of the device and can have a substantially round cross section, which becomes smaller to both sides. In other words, the at least one deflection element can be suitably adapted to the three-dimensionally convex surface of the first layer and therefore to the sole of a human foot, and this favors a function of the device in supporting the human foot. The deflection element is made of a material which can withstand the mechanical loads that occur and which as far as possible does not limit the bending flexibility of the overall device. For this purpose, the at least one deflection element is stable under pressure and flexurally elastic.

Additionally or alternatively to the at least one deflection element, an assemblage of a plurality of individual deflection bodies or support elements (second deflection elements) can be provided in non-limiting embodiments. Such an assemblage of second deflection elements can support or realize the function of the described at least one deflection element. Here, the individual deflection bodies (second deflection elements) of the assemblage are elastic. The deflection bodies (second deflection elements) can support the form of the first layer through their shape and arrangement and can also favor the bulging of the first layer during the upward flexion of the forefoot.

The at least one deflection element and/or the deflection elements of the assemblage of the plurality of deflection bodies (second deflection elements) comprise a material such as, for example, a strong plastic material, for example polyethylene (PE), polyvinyl chloride (PVC), polyamide 11 (PA11), polyamide 12 (PA12), polylactides (PLA), acrylonitrile-butadiene-styrene copolymer (ABS) and/or a fiber composite such as Kevlar, carbon or glass fiber composites. In a non-limiting embodiment, the at least one deflection element and/or the deflection bodies (second deflection elements) comprise the same material as the first layer or consist of this material.

As has been described above, the at least one deflection element is arranged, according to a non-limiting embodiment, at least partially between the first layer and the second layer and thus provides a predefined desired spacing between the first layer and the second layer. In a non-limiting embodiment, the second layer is tensioned via the deflection element between respective connection regions to the first layer in the forefoot region (second end region) and in the heel region (first end region). The tensioning has the effect that an arch formed by the first layer is (at least partially and/or in some sections) retained even in the loaded state (when a user is standing on the device used in the shoe). In particular, the tensioning is such that the arch is retained at least in the metatarsal region (central region). The at least one deflection element permits a movement of the layers relative to each other.

In other words, the second layer, such as between the connection regions to the first layer, is tensioned via the deflection element on the first layer in the manner of a bowstring on a bow. When, on account of dorsiflexion of the device in the forefoot region (second end region), a corresponding stress or force is transmitted via the second layer to the first layer in the heel region (first end region) and the first layer is thus bent further, and its corresponding arch height increased, deformation energy is stored, which is then freed again as the device bends back in the forefoot region (first end region).

As has been mentioned, the device can be divided into a heel region, a metatarsal region and a forefoot region. In different embodiments, the second end region corresponds to the forefoot region, the first end region corresponds to the heel region, and the central region corresponds to the metatarsal region. In different embodiments, the length of the forefoot region along a longitudinal axis of the device measures about 25% to 45% of a total length of the device, the corresponding length of the heel region measures about 5% to 25% of the total length, and the corresponding length of the metatarsal region measures about 40% to 60% of the total length.

The device is thus able to simulate the windlass effect and also the spring action of the tendons of the foot muscles. The device is thus able to actively support a foot during walking or running and to do so in a natural way. Foot pathologies, e.g. flatfoot, pes valgo planus, splay foot and hollow foot, can thus be actively supported and corrected by the device. Alternatively or additionally, the device can also be used to support the feet during various sports activities.

A further effect of the device is that it can provide a shock-absorbing function even in the early stance phases, e.g. when walking, running, jumping, etc., it permits pronation, and it can store energy until the end of the contact with the ground. The device can thus actively raise the back of the foot by support of the windlass mechanism and thus has a positive influence on the apparatus of locomotion. By means of the supporting windlass mechanism, the foot is supported during locking. This effect is achieved in particular if the second layer is stretched relative to the first layer via the deflection element and does not directly contact the first layer in the metatarsal region (in the unloaded state). However, it is also possible, for example, that a filler material supporting the stability of the device is also provided between the layers in the metatarsal region, via which filler material the second layer then indirectly contacts the first layer.

The result is that the interplay of the first layer, the second layer and the at least one deflection element can permit a device which is capable of torsion about the longitudinal axis, is flexurally elastic about the transverse axis, and is adapted to a respective foot. The device can have different degrees of bending flexibility and torsional flexibility in different areas.

The present disclosure also makes available a shoe which comprises an above-described device for supporting the human foot. The device is suitable for use with any type of shoes, in particular with custom-made orthopedic shoes, but also with normal shoes (everyday shoes, business shoes) or sports shoes. In a non-limiting embodiment, the device can be an insole, which can be arranged removably in the shoe. Alternatively, in a non-limiting embodiment, the device can be arranged permanently in the shoe or can be designed as part of a shoe and/or of a sole of a shoe.

BRIEF DESCRIPTION OF THE DRAWINGS

The accompanying drawings serve to provide an understanding of non-limiting embodiments. The drawings illustrate non-limiting embodiments and, with the description, serve to explain them. Further non-limiting embodiments and numerous intended advantages emerge directly from the following detailed description. The elements and structures shown in the drawings are not necessarily shown true to scale. Identical reference numerals refer to identical or corresponding elements and structures.

Embodiments are explained in more detail below and are set out in the figures, in which.

DETAILED DESCRIPTION

Figure 1:
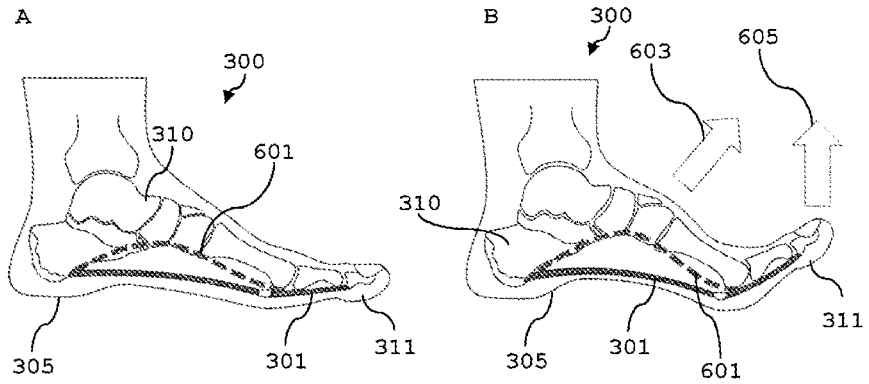
FIG. 1 shows schematic views of the human foot in order to illustrate the windlass mechanism.

FIG. 1 illustrates the windlass mechanism using the example of a schematically depicted foot 300. In the left-hand part A of the figure, the foot 300 is shown in a cross-sectional view which reveals in particular the bones 310 of the foot which are curved upward along the arch 601 indicated by a dashed line. Upon dorsiflexion of the toes 311, i.e. an upward hyperextension of the toes 311, as is shown by arrow 605 in FIG. 1B, tendons 301 of the toe flexor muscles (not shown), lying on the plantar aspect 305, and the plantar fascia are tensioned. As is indicated in FIGS. 1A and 1B by a corresponding change of the arch 601 and by the arrow 603, the metatarsal region 310 is thus elevated. The height of the arch 601 increases. Analogously to a bowstring tensioned on a bow, this causes deformation energy to be stored which, upon relaxation, can be used for acceleration. During walking for example, the deformation energy is released particularly at toe-off and is used for acceleration work for lifting the foot 300.

Figure 2:
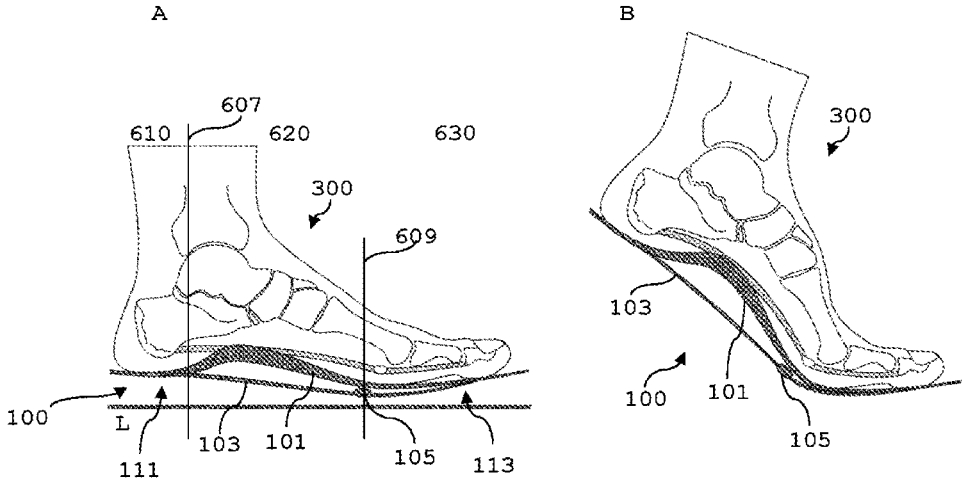
FIG. 2 shows schematic views of the human foot, with a device for supporting the foot.

FIG. 2 shows the foot 300 according to FIG. 1 and a device 100 for supporting the foot 300, which device 100 is used inside a shoe (not shown) in order to support the foot 300. As is shown, the device 100 can be divided (corresponding to the foot 300) into a heel region 610 (a first end region 610), a metatarsal region 620 (a central region 620) and a forefoot region 630 (a second end region 360), which extend along a longitudinal axis L of the device 100 and which are divided in the figure by lines 607 and 609.

As is shown, the device 100 first of all comprises a first layer 101 which is directed toward the foot 300 when arranged in the shoe (not shown) and which is thus an upper layer when a shoe is placed on the ground. This first layer 101 forms an arch in the foot direction in the metatarsal region 620 and is connected to a second layer 103 in the region 111 of the heel region 610 and in the region 113 of the forefoot region 630. As is shown, the second layer 103 is arranged on a side of the device 100 directed away from the foot 300 and from the arch of the first layer 101 when arranged in the shoe (not shown). The second layer 103 is thus arranged under the first layer 101 when the shoe (not shown) is placed on the ground. A deflection element 105, which is connected to the second layer 103, is arranged here between the first layer 101 and the second layer 103. The deflection element can, for example, be formed integrally with the second layer 103. A connection between the second layer 103 and the deflection element prevents undesired shifting of the deflection element 105 inside the device 100, for example along the longitudinal axis L, which shifting would change the function of the layers 101, 103. Bending about the transverse axis is facilitated here, since the second layer 103 has no three-dimensional profiling in the frontal plane. However, it is also possible to integrate the deflection element at least partially in the first layer 101.

As can be seen in FIG. 2, the second layer 103 is tensioned via the deflection element 105 between the connection regions 111 and 113 of the heel region 610 and of the forefoot region 630 to the first layer 101. In a bow and bowstring model, the second layer 103 thus corresponds to the bowstring, while the first layer 101 corresponds to the bow. The deflection element 105 predefines a predetermined spacing between the layers 101, 103, which spacing can be adjusted by dimensioning and positioning of the deflection element 105. As is also shown in the figure, the second layer 103 contacts the first layer 101 in the forefoot region 630. These layers 101, 103 are thus movable relative to each other.

As can be seen in particular from FIG. 2B, the second layer 103 is designed such that a tension or force acting in the forefoot region 630, during the indicated dorsiflexion of the device 100, is transmitted via the deflection element 105 to the first layer 101 in the heel region 610 such that a height of the arch formed by the first layer 101 increases. This corresponds to the described natural enlargement of the arch 601 of the bones 310 of the foot in FIG. 1B during the upward extension of the toes 311 (in the direction of arrow 605), which supports raising and locking of the foot 300 and thus the windlass mechanism of the foot. Here, the deflection element 105 has in particular the effect of intensifying the enlargement of the arch, which can be suitably adjusted by suitable dimensioning and positioning of the deflection element 105 between the layers 101, 103.

In other words, the device according to a non-limiting embodiment is able to technically implement the above-described interplay between flexibility and stability of the feet, the so-called windlass effect, in the form of an insole supporting the foot, or as a device integrated rigidly in a shoe, and can thus actively support the foot. A deflection element may be provided for tensioning the second layer 103, via which a spacing between the first layer 101 and the second layer 103 can be adjusted, as a result of which the functionality of the device can be adapted to individual requirements.

The device does not just adapt to the foot during the gait cycle, it actively supports the foot. The device may thus able to actively raise a foot, for example during walking or running, and to guide the foot in the actual realization of the windlass effect. Through the provision of the at least one deflection element 105 in the transition region from forefoot region to metatarsal region, it is possible to actively support the enlargement of the arch within the metatarsal region, and this supports the lever function of the forefoot region and of the metatarsal region, which lever function is necessary for the propulsion during walking. By virtue of the bow and bowstring design with a deflection element, the device moreover supports the spring action of the toe flexor tendons, which action is generated by pretensioning of the corresponding muscles at heel lift and hyperextension of the toes. Moreover, this design of the device also supports the shock-absorbing function of the feet.

The device 100 can thus be used to compensate for pathological changes of the feet. In particular, foot pathologies such as flatfoot, pes valgo planus, splay foot and hollow foot can be actively supported and corrected with the device. Alternatively or in addition, however, the device can also be used to support the feet during sports activity, for example when the device is arranged in a sports shoe (permanently or removably).

Figure 3:
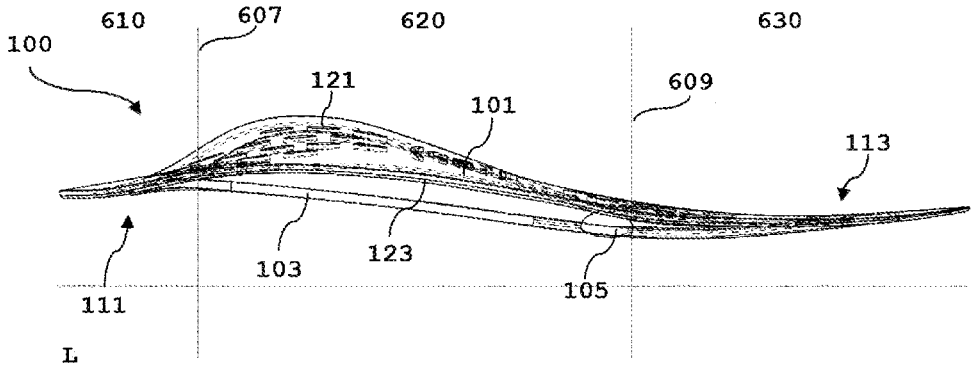
FIG. 3 shows a side view of a device for supporting the foot.
Figure 4:
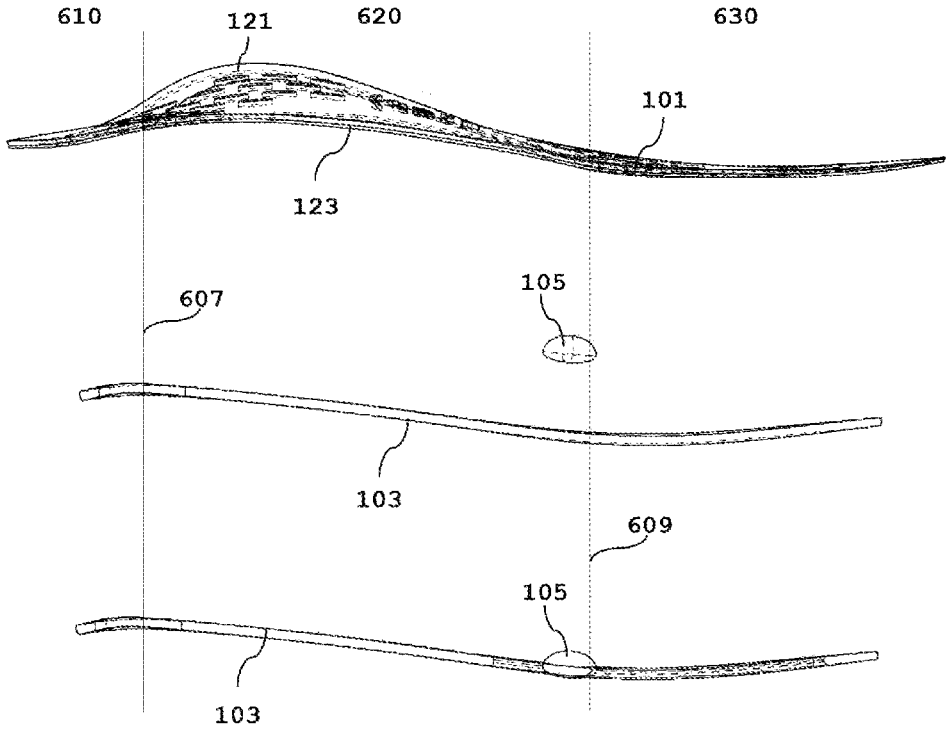
FIG. 4 shows a view of individual components of the device for supporting the foot.

FIG. 3 shows a schematic side view of the device 100 in the assembled state, and FIG. 4 shows the individual components from FIG. 3. The device 100 is an insole, which can be arranged removably in a shoe. Alternatively, the device 100 can also be arranged permanently in a shoe, in which case the second layer 103 is either rigidly connected to a sole of the shoe or is a partial layer of the sole of the shoe.

As is shown in FIG. 3, the first layer 101 is connected to the second layer 103 in the region 111 of the heel region 610 and in the region 101 of the forefoot region 630. Here, the first layer 103 is a two-dimensional structure for example of polyethylene (PE), polyvinyl chloride (PVC), polyamides (PA), polyamide 11 (PA11), polyamide 12 (PA12), polylactides (PLA), acrylonitrile-butadiene-styrene copolymer (ABS) and/or a fiber composite such as Kevlar, carbon or glass fiber composite, or one or more of various metallic substances and/or other also additively processible or expansive materials such as polyurethanes (PU), thermoplastic polyurethane (TPU), PLE, nylon, various elastomers, and is stretched convexly upward to give a three-dimensional form. In other words, the first layer 101 forms a highest arch along the longitudinal axis L of the device 100 in a region (the region 121 of greatest arch height in the figure) of the first layer 101, which arch becomes smaller toward a region 123 of the first layer 101. In other words, in this case the first layer forms a three-dimensionally stretched, such as a convex surface, which is adapted to the sole of the human foot. The deflection element 105, which is arranged between the layers 101, 103 in FIG. 3 and is arranged in a transition region between the forefoot region 630 and the metatarsal region 620, is shown separately in FIG. 4. In the case shown, the deflection element 105 is arranged slightly offset to the left from the dividing line 609 and, with the same dimensioning of the deflection element 105, this leads to a smaller spacing in the forefoot region between the first layer 101 and the second layer 103 compared to a case where the deflection element 105 is offset to the right from the line 609. There is therefore an optimization of the structural height in the forefoot region.

Figure 5:
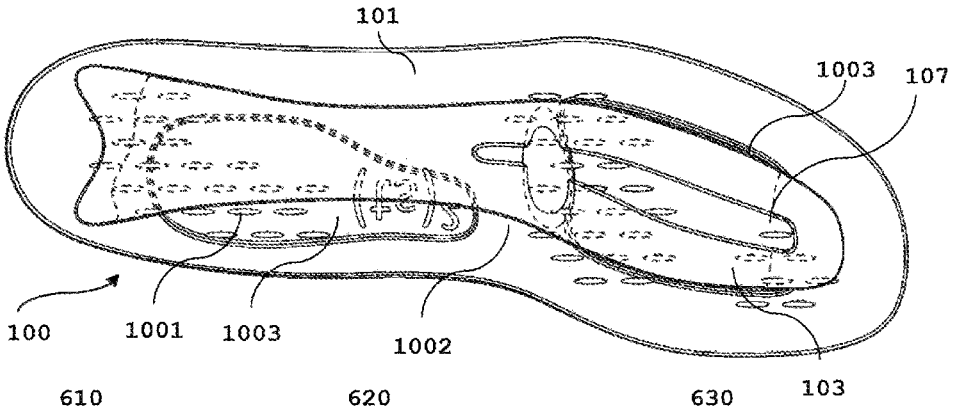
FIG. 5 shows a plan view of a device for supporting the foot.
Figure 6:
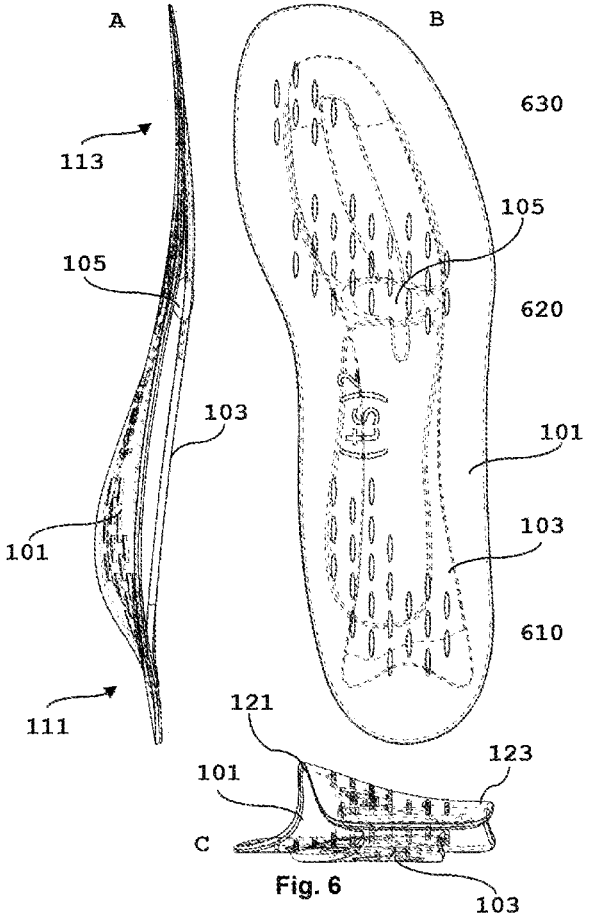
FIG. 6 shows various views of a device for supporting the foot.

FIG. 5 shows a plan view of the device 100 in which the second layer 103 is arranged above the first layer 101 (a view from below, when the device 100 is arranged in a shoe—the second layer 103 is visible through the first layer 101). FIG. 6, in addition to the plan view (part B), also shows a side view (part A) and a view along the longitudinal axis of the device 100 from the heel region 610 to the forefoot region 630 (part C). As can be seen from the figure, both the first layer 101 and the second layer 103 are of a two-dimensional design, wherein a smallest width of the second layer 103 (in the figure plane) is so wide that the second layer 103 can take up the stresses occurring in the individual regions, an overloading of the material is prevented, and an optimized strength to weight ratio is ensured. The width of the layers is here a width along a plane parallel to the ground when the device 100 is arranged in a shoe and the latter is placed on the ground. On account of the width of the second layer 103, the latter is strong enough to fulfil the function of a bowstring in the above-described bow and bowstring model.

FIG. 6C shows the region 121 of the greatest arch height and the region 123 of the smallest arch height. As can be seen from this figure, the convexity of the first layer 101 is thus adapted to the three-dimensional shape of the sole of the human foot and can thus also vary in its shape on an individual basis.

It can be seen in particular from FIGS. 5 and 6 that the second layer 103 is narrowed toward the rear and, in relation to the first layer 101, is shaped such that it can take up the occurring stresses in an optimal manner. As is shown in FIG. 5, the second layer 103, in particular in the forefoot region, has a suitable width for ensuring that a suitable form-fit can be generated between the first layer 101 and the second layer 103.

FIGS. 5 and 6 also show that the first layer 101 has elongate oval slits/perforations which serve to reduce axial and polar resistance moments. As is shown, the first layer 101 for this purpose comprises a plurality of depressions or openings 1001, which are of an elongate oval shape. In the case shown, these are formed as a plurality of holes 1001, i.e. as openings which penetrate the first layer 101 completely. As has been mentioned, it is alternatively or additionally possible also to provide depressions which, in the manner of a blind bore, reach only partially through the first layer. By adaptation of the plurality of depressions 1001 or openings 1001 in the first layer 101, a bending flexibility and torsion flexibility can be adapted in different regions of the first layer 101. At the same time, the plurality of depressions 1001 or openings 1001 can permit an increase in cutaneous secretion and air circulation.

FIG. 5 also indicates a region 1002 in which a material thickening of the first layer 101 at the height of the deflection element 105 is provided as a mechanical counterbearing and for stabilizing the layer 101 and the deflection element 105. A planar indentation of the first layer 101 and a reduction of the material thickness of the first layer 101 are also shown in a region 1003. In this way, increased flexibility is achieved in a targeted manner in these regions.

Figure 7:
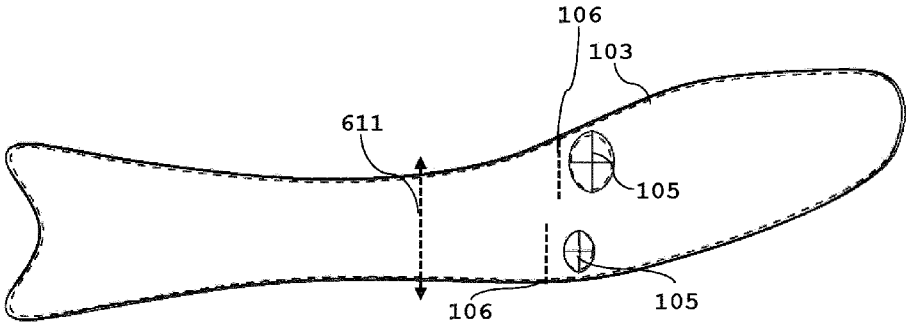
FIG. 7 shows a second layer of a device for supporting the foot.

FIG. 7 shows the second layer 103 with two deflection elements 105 of different sizes. An arrangement of more than one deflection element 105 allows the deflection elements 105 to be adapted suitably to a shape of the upwardly convex first layer 101 and thus to the sole of the foot. By means of different sizes of deflection elements 105, correspondingly different spacings can be set between first layer and second layer. Thus, by distributing suitably dimensioned deflection elements along a width of the device, the desired effect can be suitably adapted to the human foot.

Figure 8:
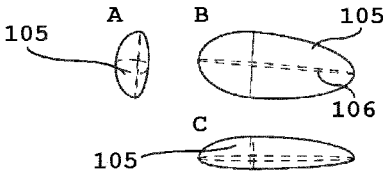
FIG. 8 shows various views of a deflection element of a device for supporting the foot.

Deflection elements 105 can be shaped as shown in FIG. 8 for example. FIG. 8 shows a deflection element in a cross-sectional view (part A), a first side view (part B), and a second side view (part C) rotated 90° about the longitudinal axis 106 of the deflection element 105 compared to the first side view. In other words, the deflection elements in non-limiting embodiments can have at least in part a substantially oval cross section, which supports adaptation of the device to the sole of a human foot. The shape of the deflection element 105 can be adapted to support the bow and bowstring mechanism of the first layer 101 and of the second layer 103. For this purpose, the deflection element 105 can be designed as an elongate element having at least in part an oval cross section. As is shown in FIG. 7, a longitudinal axis 106 of the deflection element 105 is oriented substantially in the direction of a width direction 611. To put it another way, this longitudinal axis 106 of the deflection element 105 forms an angle in the range of 60° to 120° with the longitudinal axis L (see FIG. 3) of the device 100. In a non-limiting embodiment, the deflection element is produced from polyethylene (PE), polyvinyl chloride (PVC), polyamides (PA), polyamide 11 (PA11), polyamide 12 (PA12), polylactides (PLA), acrylonitrile-butadiene-styrene copolymer (ABS) and/or a fiber composite such as Kevlar, carbon or glass fiber composite, various metallic substances, or other also additively processible materials. With a suitable choice, in particular from these materials, an optimal weight to strength ratio can be achieved, such that the deflection element can be tension-resistant, dimensionally stable, compression-resistant, flexurally elastic and torsionally elastic.

Figure 9:
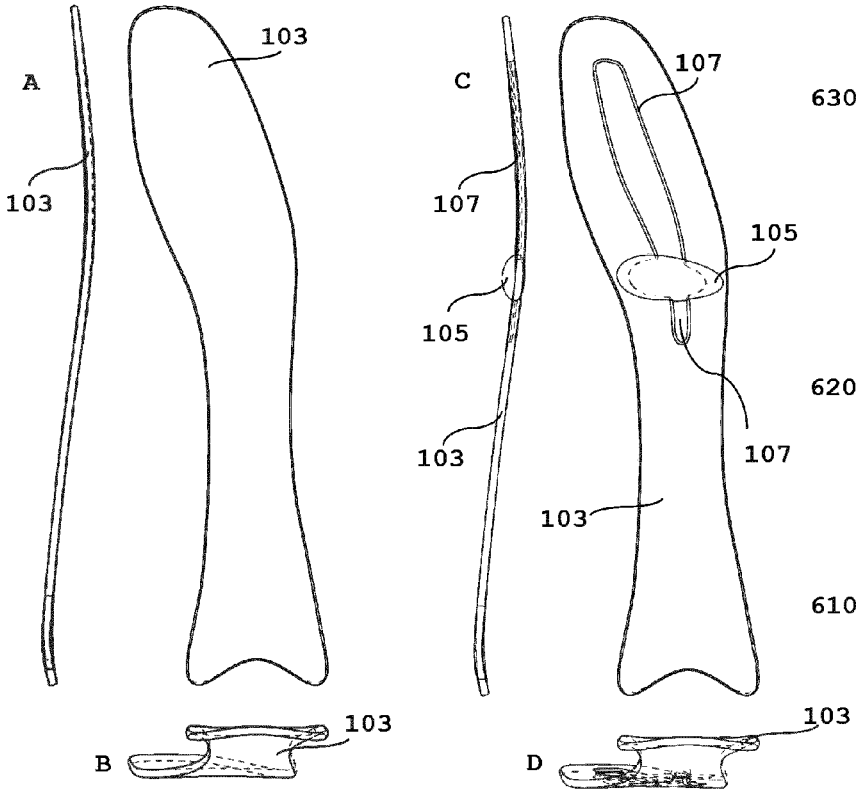
FIG. 9 shows various views of a second layer of a device for supporting the foot.

FIG. 9 shows a second layer 103 without deflection element 105 (part A, in a side view on the left and in a plan view on the right), and a second layer 103 with a deflection element 105 in a further embodiment (part C, in a side view on the left and in a plan view on the right). Parts B and D in FIG. 9 show the corresponding second layers 103 of the respective parts A and C shown above, seen from the rear along the longitudinal axis of the device 100 from a heel region 610 in the direction of the forefoot region 630. As is shown, the second layer 103 in this non-limiting embodiment comprises an elongate oval cutout 107, which serves to reduce the axial and polar resistance moment. In non-limiting embodiments, the second layer 103 can thus have at least one elongate oval cutout which is oriented substantially along a longitudinal direction of the second layer 103. A plurality of such cutouts can also be provided. As is shown in the figure, the elongate oval cutout 107 in the example shown extends from the forefoot region 630 on the second layer 103 into the metatarsal region 620 via the deflection element 105.

Figure 10:
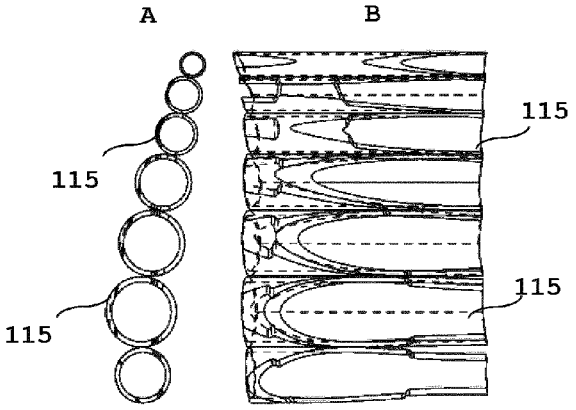
FIG. 10 shows a plurality of second deflection elements of a device for supporting the foot.

In a non-limiting embodiment, the device 100 can have a plurality of deflection bodies or support elements (second deflection elements 115) in addition to or alternatively to the described at least one deflection element 105. In both cases, these deflection bodies, support elements, second deflection elements 115 can form an assemblage in which the deflection bodies, support elements, second deflection elements 115 are rigidly connected to each other. FIG. 10 shows an assemblage of a plurality of such second deflection elements 115 in a side view (A) and in a plan view (B). For the sake of clarity, only two of the second deflection elements 115 are designated in the figure. As is shown, these second deflection elements are substantially tubular and have a substantially circular cross section. As is shown, the second deflection elements 115, at least in the metatarsal region of the device, are in contact with each other and/or rigidly connected to each other in a direction which corresponds to a longitudinal axis of the device 100. By virtue of this flush arrangement of the second support elements 115 and by virtue of a suitable geometrical configuration, for example, of the individual cross sections of the respective second support elements, for example according to the shape of a foot, the first layer 101 in the metatarsal region is advantageously stretched/elevated during deformation of the device about a transverse axis (in particular during dorsiflexion of the device in the forefoot region). This elevation of the first layer, i.e. the enlargement of the corresponding arch height, is actively supported by the second deflection elements.

The second deflection elements 115, which form the assemblage of the plurality of second deflection elements 115, are rigidly connected to each other. For this purpose, the second deflection elements 115 in different embodiments can be connected cohesively (for example adhesively bonded, crosslinked, welded, additively processed, vulcanized or soldered). For this purpose, the second deflection elements 115 in different embodiments can also be connected by form-fit engagement, for example via a tongue-and-groove connection, a toothed connection or a dovetail connection. For this purpose, the second deflection elements 115 in different embodiments can be connected by force-fit engagement, for example via a hook-and-loop fastener. For this purpose, the second deflection elements 115 in different embodiments can be connected by form-fit and force-fit engagement, for example riveted or screwed.

In a non-limiting embodiment, the second deflection elements 115 are made of, for example, polyethylene (PE), polyvinyl chloride (PVC), polyamides (PA), polyamide 11 (PA11), polyamide 12 (PA12), polylactides (PLA), acrylonitrile-butadiene-styrene copolymer (ABS) and/or a fiber composite such as Kevlar, carbon or glass fiber composite, or one or more of various metallic substances and/or other also additively processible or expansive materials such as polyurethanes (PU), thermoplastic polyurethane (TPU), PLE, nylon, or various elastomers.

The assemblage of the second deflection elements 115 is thus an assemblage of three-dimensional bodies which are geometrically arranged such that it is possible to directly influence all the bodies or each individual body. The illustrated assemblage of second deflection elements 115 supports the stability of the first layer 101 in the metatarsal region upon application of a surface load, for example caused by a foot.

In a non-limiting embodiment, the second deflection elements 115 are of a tubular shape, as is illustrated. The tubular shape has proven a suitable cross section as regards the longitudinal direction of these second deflection elements 115 since, in the event of a reduction of the width of a tube, the latter gains in height if a corresponding second support element 115 is deformed elastically. This shape thus supports the described enlargement of the arch height of the first layer 101 in an advantageous manner. In alternative embodiments, the second deflection elements 115 can also be configured as hollow spheres or spherical shells. The second deflection elements 115 are elastically deformable and their respective diameters are chosen such that the arch height of the first layer 101 can be suitably adjusted. The plurality of second deflection elements can be provided additionally to the at least one first deflection element 105 in order to support the effect of the latter. In particular, the plurality of second deflection elements 115 can permit particularly controlled lowering and lifting of the first layer 101 during the gait cycle.

Figure 11:
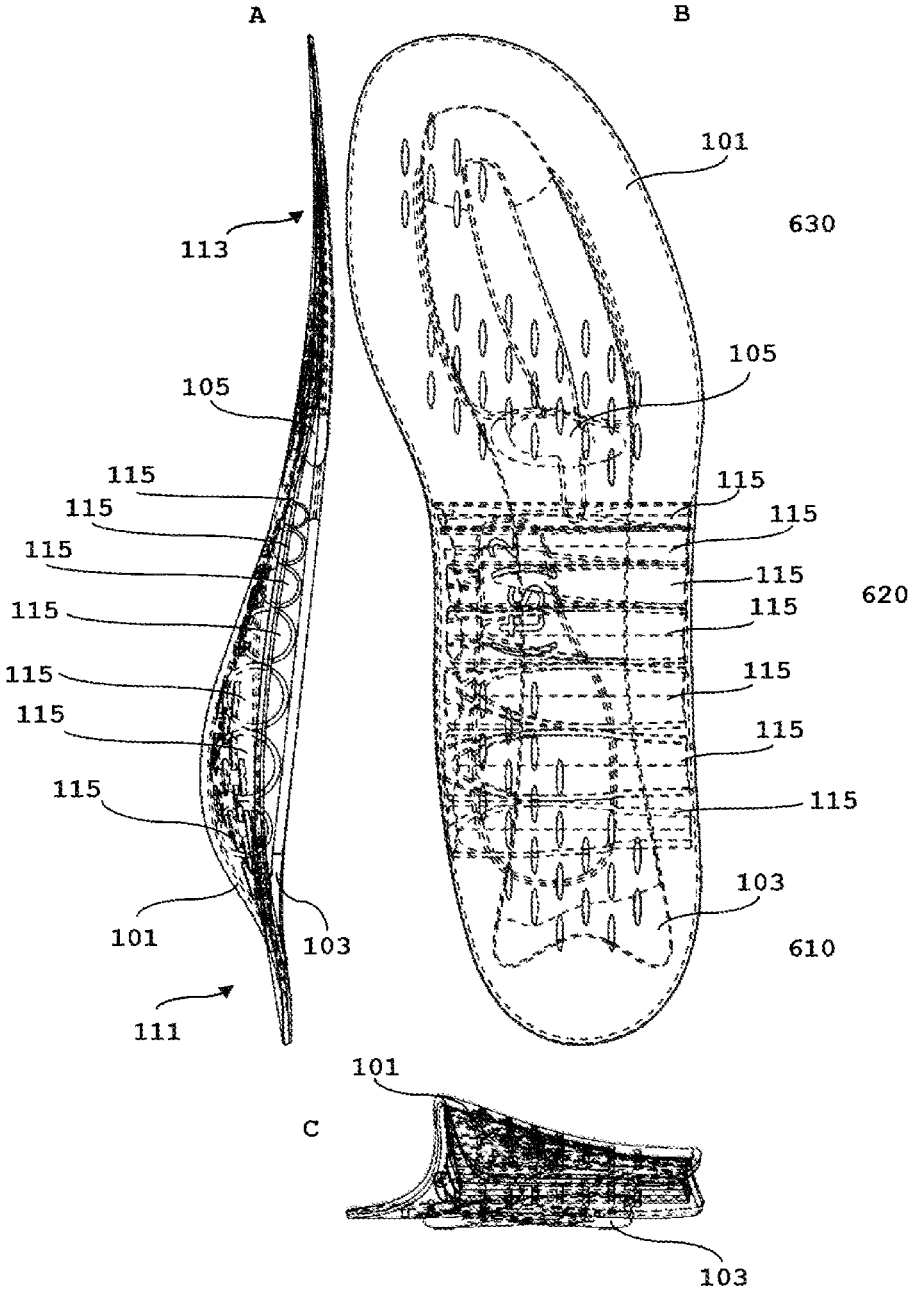
FIG. 11 shows a device for supporting the foot, with a plurality of second deflection elements.

Such a design, in which the device 100 has the plurality of second deflection elements 115 additionally to the above-described first deflection element 105, is shown in FIG. 11. Here, FIG. 11A shows a side view, FIG. 11B a plan view, and FIG. 11C a view from the rear, from the heel region 610 toward the forefoot region 630 of the device. As is shown, the second deflection elements 115, at least in the metatarsal region 620 (central region 620), are arranged next to and in contact with each other along the longitudinal axis (see FIG. 3) of the device 100. As can be seen from FIG. 11, the individual second deflection elements 115 are arranged in a width direction of the device 100 between the first layer 101 and the second layer 103, wherein a thickness of the respective substantially cylindrical deflection elements 115 can be suitably adapted, for example, to a shape of the first layer 101. As is shown, the plurality of the second deflection elements 115 can be used to support the function of the first deflection element 105. Alternatively, in a non-limiting embodiment, the plurality of the second deflection elements 115 can replace the first deflection element 105.

The invention claimed is:

1. A device for supporting the human foot, wherein the device comprises:

at least one first layer, which forms an arch at least in a central region of the device;

at least one second layer connected to the first layer in a first connection region of a first end region in a heel region of the device and in a second connection region of a second end region in a forefoot region of the device; and at least one deflection element arranged between the first connection region and the second connection region and at least partially between the first layer and the second layer, wherein the at least one deflection element is rigid such that the first layer and the second layer have, at the location of the at least one deflection element, a fixed spacing from each other that is predefined by the at least one deflection element;

wherein the at least one deflection element is arranged at least partially between the first layer and the second layer in a transition region between the forefoot region to a metatarsal region of the device and defines a spacing between the first layer and the second layer between the at least one deflection element and the second connection region;

wherein a peak of the at least one deflection element is disposed in the transition region;

wherein the first layer and the second layer are movable relative to each other between the first connection region and the second connection region, such that during dorsiflexion of the device the spacing between the first layer and the second layer increases between the first connection region and the at least one deflection element and the spacing between the first layer and the second layer decreases between the second connection region and the at least one deflection element;

wherein the second layer is tensioned between the first connection region and the second connection region via the at least one deflection element, and wherein tension in the second end region, during dorsiflexion of the device, is transmitted, via the at least one deflection element, to the first layer in the first end region in such a way that the dorsiflexion leads to an increase in a height of the arch formed by the first layer.

2. The device as claimed in claim 1, wherein the at least one deflection element is a separate element.

3. The device as claimed in claim 1, wherein the at least one deflection element is rigidly connected to the first layer and/or to the second layer or is formed integrally with the first layer and/or with the second layer.

4. The device as claimed in claim 1, wherein the second layer, in a first connection region in the first end region and in a second connection region in the second end region, is rigidly connected to the first layer or is formed integrally with the first layer.

5. The device as claimed in claim 1, wherein the first layer has a plurality of depressions, which reach partially through the first layer, and/or openings, which penetrate the first layer completely.

6. The device as claimed in claim 1, wherein the second layer has at least one cutout, which is oriented substantially along a longitudinal direction of the second layer.

7. The device as claimed in claim 1, further comprising an assemblage of a plurality of support elements which, at least in the central region, are arranged next to each other and in contact with each other along a longitudinal axis of the device, between the first layer and the second layer.

8. The device as claimed in claim 7, wherein the support elements, which form the assemblage of the plurality of support elements, are rigidly connected to each other and separate from the at least one deflection element.

9. The device as claimed in claim 7, wherein the support elements, which form the assemblage of the plurality of support elements, are substantially tubular and elastic and are of different sizes according to a shape of a foot.

10. The device as claimed in claim 1, wherein the device is an insole.

11. A shoe comprising the device as claimed in claim 1.

12. The device as claimed in claim 1, wherein a position of the at least one deflection element is configured to provide a windlass effect for the human foot.

13. The device as claimed in claim 1, wherein the at least one deflection element is arranged at a distance ranging from 45% to 85% of a total length of the device where said distance is measured from a start of the first end region in the heel region in the direction of the second end region in the forefoot region along a longitudinal axis.

14. The device as claimed in claim 1, wherein the second layer is tensioned such that the second layer is stretched relative to the first layer via the at least one deflection element.

15. The device as claimed in claim 1, wherein the at least one deflection element is an elongate element with a longitudinal axis oriented substantially in a direction of a width of the device.

16. The device as claimed in claim 15, wherein the at least one deflection comprises two elongate elements distributed along the width of the device, wherein the two elongate elements are of different sizes.

17. The device as claimed in claim 1, wherein the first layer includes a material thickening at the peak of the deflection element.

18. The device as claimed in claim 1, wherein the arch of the first layer is highest towards the heel region along a longitudinal axis of the device.

* * * * *